United States Patent [19]

Sokol

[11] 4,258,414

[45] Mar. 24, 1981

[54] UNIVERSAL TROUBLE LIGHT

[75] Inventor: Louis Sokol, Rockville Centre, N.Y.

[73] Assignee: Plymouth Products Incorporated, Oceanside, N.Y.

[21] Appl. No.: 62,583

[22] Filed: Aug. 1, 1979

[51] Int. Cl.[3] ..... F21V 21/29; F21V 21/08; F21V 15/02

[52] U.S. Cl. ..... 362/421; 362/378; 362/398

[58] Field of Search ..... 362/258, 378, 398, 421; 248/288 A, 481

[56] References Cited

U.S. PATENT DOCUMENTS

| | | | |
|---|---|---|---|
| 1,558,421 | 10/1925 | Whitsett | 362/421 |
| 1,560,458 | 11/1925 | Wise | 362/421 |
| 1,719,907 | 7/1929 | Sklarek | 362/421 |
| 1,722,773 | 7/1929 | Stewart | 362/421 |
| 2,213,649 | 9/1940 | Goodwin | 362/378 |
| 2,458,138 | 1/1949 | Blanchard | 362/398 |
| 2,774,048 | 12/1956 | Baenziger | 362/378 |
| 3,104,067 | 9/1963 | Stiffel | 362/421 |
| 3,308,289 | 3/1967 | Conradi | 362/258 |
| 3,439,159 | 4/1969 | McRoskey | 362/258 |

*Primary Examiner*—Stephen C. Bentley
*Assistant Examiner*—Edward F. Miles
*Attorney, Agent, or Firm*—Lawrence Rosen

[57] ABSTRACT

A universal trouble light includes a longitudinally extending handle and a first apertured ball and a socket therefor carried at one end of the handle. A longitudinally extending barrel member also carries a ball and socket therefor at one of its ends. The balls are rigidly connected to thereby position the handle and barrel member in spaced proximity to each other. The handle and barrel member are capable of relative rotative and angular movement. An electrical receptacle is positioned floatingly within the barrel member and electrical conductor elements connecting the receptacle with a source of electrical supply extend through the balls.

8 Claims, 3 Drawing Figures

UNIVERSAL TROUBLE LIGHT

BACKGROUND OF THE INVENTION

This invention relates to universal trouble lights and more particularly to a trouble light of the type in which a light source is mounted by means of multiple ball joints to provide for orientation of the illumination through both circular and angular orbits.

Trouble lights or lamps have been known heretofore in which the electrical receptacle and bulb are mounted for rotative and angular movement by means of one or more ball joints. However, in order to avoid twisting of the electrical cord and consequent damage thereto special construction of the ball and/or socket was required. It was also customary to employ one or more compression springs to maintain a biasing force on the ball members to insure operative relation between the balls and sockets. In addition, due to the securement of the electrical receptacle fixedly within the outermost component of the device, and the attachment of the electrical conductor leads to the receptacle, excessive movement of the receptacle housing tended to weaken the lead connections resulting ultimately in a breaking of the electrical circuit and failure of the device.

SUMMARY OF THE INVENTION

It is one object of this invention to provide a universal trouble light of the character described which permits rotation of the receptacle housing and thereby orientation of the illumination emitted through a full 360° thus obviating the need for rotation limiting structure on either the ball or socket members.

It is another object of this invention to provide a universal trouble light of the character described which provides for operative connection between the ball and socket members without the need for springs.

It is still another object of the invention to provide a universal trouble light in which the electrical receptacle for the light or lamp is so mounted as to minimize the risk of electrical conductor lead damage due to rotative and/or angular movement of the receptacle housing.

Other objects and advantages of the invention will become readily apparent to persons versed in the art to which the invention pertains from the ensuing description thereof.

In accordance with the invention there is provided a universal trouble light comprising a longitudinally extending handle; a first apertured ball and a socket therefor carried by the handle at one end thereof; a longitudinally extending barrel member; a second apertured ball and a socket for the second ball carried by the barrel member at one end thereof; a connecting element for rigidly connecting the first and second balls to thereby position said one ends of the handle and barrel member in spaced proximity to each other permitting relative rotative and angular movement therebetween; an electrical receptacle positioned floatingly within the barrel member; and electrical conductor elements extending through the balls connectable between the receptacle and a source of electrical supply.

BRIEF DESCRIPTION OF THE DRAWINGS

In order that the invention may be more fully comprehended it will now be described, by way of example, with reference to the accompanying drawings in which.

DESCRIPTION OF THE PREFERRED EMBODIMENTS

Figure 1:
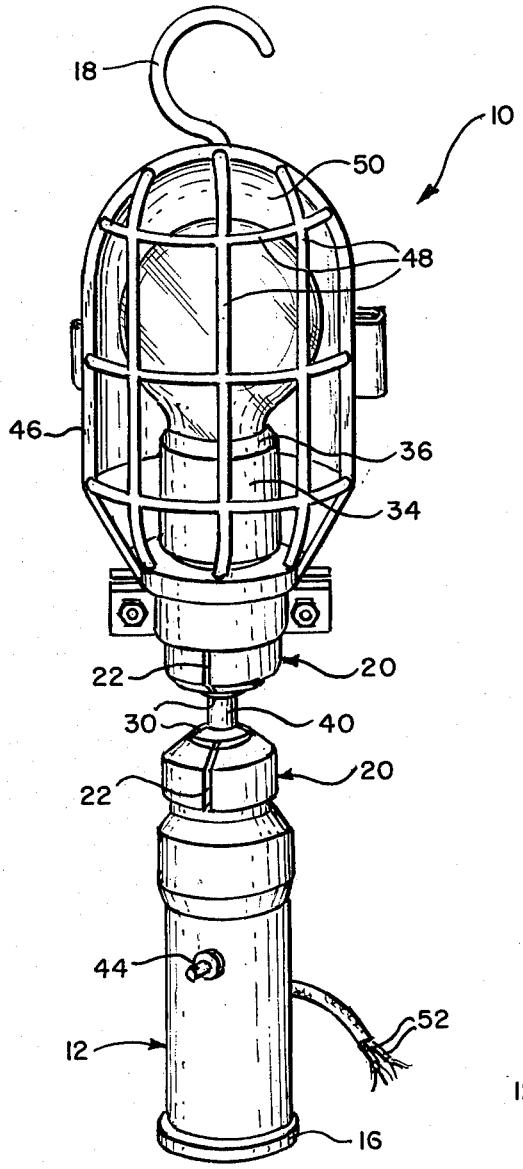
FIG. 1 is a perspective view of the trouble light of the invention with the handle and barrel member in vertically aligned relation.

Before explaining the invention in detail it is to be understood that the invention is not limited in its application to the details of construction and arrangement of parts illustrated in the drawings since the inventon is capable of other embodiments and of being practiced or carried out in various ways. It is also to be understood that the phraseology or terminology employed is for the purpose of description only and not of limitation.

Referring to the drawings, in which like parts are similarly designated, there is shown a trouble light or lamp 10. The light comprises a handle 12 which is hollow and given a set of internal threads 14 at one end thereof. One or more permanent magnets 16 are carried by the other end of the handle so as to be utilizable in cooperation with a paramagnetic support structure. By such expedient the trouble light may be releasably secured to an appropriate and convenient vertical or horizontal surface for illumination of a selected area without the need to hand-hold the trouble light. It will, of course, be recognized that a suitable paramagnetic support structure may not always be available. The trouble light is, therefore, desirably also provided with a hook element 18 for suspension therefrom.

The trouble light also comprises a socket member 20 in the form of a circularly extending collar which is split axially as at 22. The collar or socket includes a shank 24 which is given a tapered thread 26 that is cooperable with the threaded portion of the handle. A portion of the interior surface of the collar is configured spherically as at 28, the curvature being such that it will rotatably receive a ball element 30. The ball element is formed with a through aperture 32 for a purpose which will be described. It will, however, be appreciated that by virtue of the split collar and tapered thread as the collar is threaded into the associated end of the handle it is urged into closer engagement with the ball element so as to insure retention of the ball element within the spherical configuration of the collar while nevertheless permitting rotational movement of the ball element.

The trouble light further comprises a barrel member 34 which serves as a housing for an electrical receptacle 36 positioned therewithin. One end of the barrel member is internally threaded at 38 in the same manner as the handle. A second socket or collar 20 includes a shank 24 which is threaded externally at 26 in the same manner as that of collar 20 previously described. A second ball element 30 is provided which is receivable within the second collar. The second collar is given a spherical interior surface as described earlier so that upon threading the second collar into its associated barrel member the second ball element is retained rotatably within the second collar.

Figure 2:
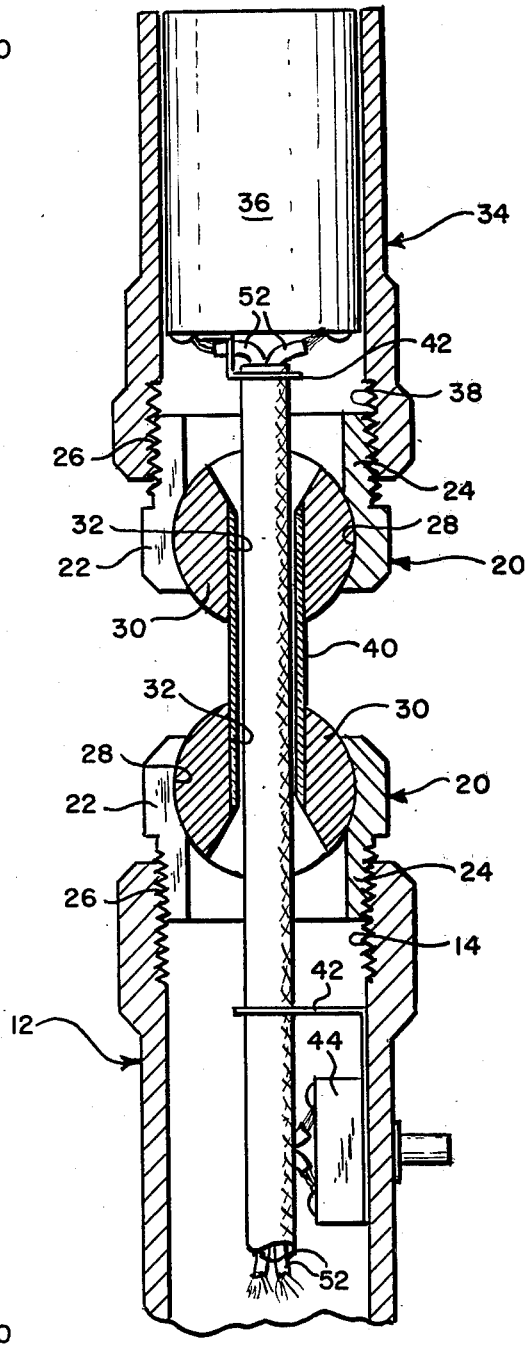
FIG. 2 is a fragmentary side view of the trouble light shown in FIG. 1 with a portion of the handle and barrel member broken away to reveal the interiors and partly in cross-section showing details of the ends of the handle and barrel member and their relationship to the ball and sockets associated therewith.
Figure 3:
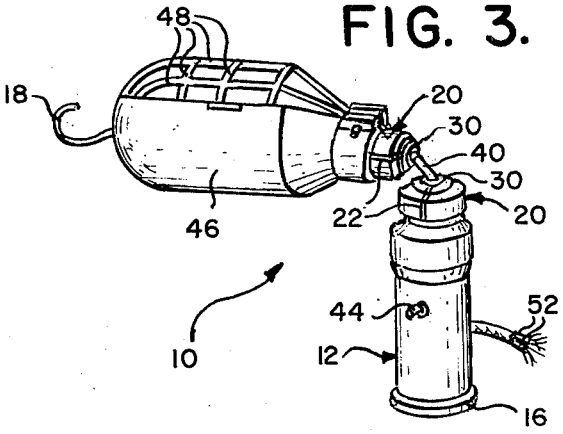
FIG. 3 is a view similar to that of FIG. 1 showing the receptacle housing in an angularly oriented position.

Interconnecting the two ball elements 30 there is provided a rigid sleeve member 40. The sleeve member is secured to the ball elements so as not to obstruct apertures 32, the sleeve member preferably being secured to the ball elements to be concentric with apertures 32 as can be seen from FIG. 2. The sleeve should be formed of a material possessing adequate strength to support the barrel member 34 in cantilever-type suspension such as depicted in FIG. 3.

As stated previously, there is positioned within the barrel member 34 an electrical receptacle 36 of conventional design and capable of receiving therein a bulb or other appropriate source of illumination. The receptacle 36 is floatingly positioned within the barrel member. The presently preferred expedient for floatingly supporting the receptacle is by providing a mounting element on the receptacle and within the handle. The electrical conductor elements 52 are secured at one end to the mounting element on the receptacle and at the other end to a switch member 44 which in turn is carried by the mounting element in the handle. It is presently preferred that such mounting elements comprise hickeys 42. However, it will be understood that other types of mounting elements may be substituted for the hickeys as long as it is assured that the receptacle be floatingly positioned within the barrel member.

The barrel member desirably terminates at its outer extremity in a cage like housing 46 which may be formed by a network of wire elements 48. A portion of the cage housing is preferably provided with a reflective surface 50 for reflection of the rays of light in a selected direction.

Electrical conductor elements 52 extend through sleeve 40 and are connected at their outer extremities to the terminals on the receptacle. A switch 44 is interposed in the circuit between the receptacle and the source of electrical power in conventional manner, and, as stated earlier, the inner terminii of the electrical conductor 52 are connected to the switch. A suitable opening is formed in the wall of the handle to enable actuation of the switch. There would appear to be no reason to unnecessarily encumber the present specification with the details of such a switch mechanism.

From the foregoing description it will be clear that although the barrel member may be both rotated about its ball element and angularly oriented relative to the handle no stress will be placed upon electrical conductors 52 or upon the connection of such conductors with the terminals of the receptacle. Also, there is no requirement that springs be employed to maintain operative engagement between the collars or sockets and the ball elements. The degree of operative engagement can be controlled through the extent of threading of the respective collar into the handle or barrel member. Additionally, barrel member 34 is capable of unlimited rotational movement about its ball element without in any manner imparting twist to the electrical conductors. Consequently the risk of loosening the electrical connection at the terminals of the receptacle is obviated. A more rugged and reliable device is thus provided.

It will be understood that the handle, barrel member and sleeve member may be fabricated from any suitable material such as a plastics material, e.g. a high impact strength polymer, metal, etc. The electrical conductor elements may be embedded in an electrically insulating material. However, it will be appreciated that the precise form of such members may be selected to suit the particular design of the associated components of the trouble light.

Although the invention has been described in specific terms it will be understood that various changes may be made in size, shape, materials and in the arrangement of the parts without departing from the spirit and scope of the invention as claimed.

Having thus set forth the nature of the invention, what is claimed herein is:

1. A universal trouble light comprising:

a longitudinally extending handle;

a first ball element having a through aperture formed therein and a socket for said ball element adapted to rotatably retain same and be carried by said handle at one end thereof;

a longitudinally extending barrel member;

a second ball element having a through aperture formed therein and a socket for said second ball element adapted to rotatably retain same and be carried by said barrel member at one end thereof;

a hollow sleeve member rigidly connecting said first and second ball elements to thereby position said one ends of said handle and barrel member in spaced proximity to each other permitting relative rotative and angular movement therebetween;

an electrical receptacle positioned floatingly within said barrel member;

and electrical conductor elements extending through the apertures in said ball elements and through said sleeve connecting said receptacle with a source of electrical supply.

2. A trouble light according to claim 1, wherein said handle and barrel member are hollow and the respective said one ends thereof are internally threaded, the said sockets associated respectively with said first and second ball elements each comprising a circularly extending collar having an axial split therein, each said collar having a spherically-configured interior portion complementary with the exterior surface of the associated ball element for rotatably retaining same and each of said collars having an external tapered threaded portion cooperable with the threads of the handle and barrel member for adjustably regulating the degree of retaining force exerted by the collars on said ball elements.

3. A trouble light according to claims 1 or 2, including a first coupling element mounted on said receptacle and a second coupling element mounted within said handle, said electrical conductors being connected at one end thereof to said first coupling element and secured at the other end thereof by said second coupling element.

4. A trouble light according to claim 3, including switch means mounted within said handle and actuable externally thereof said other end of said electrical conductor elements being connected to said switch means.

5. A trouble light according to claim 3, wherein said first and second coupling elements comprise hickeys.

6. A trouble light according to claim 1, including at least one permanent magnet carried by said handle cooperable with a paramagnetic support structure.

7. A trouble light according to claim 1, wherein said barrel member includes a cage-like housing and light-reflective section.

8. A trouble light according to claim 1, including a hook element carried by said barrel member.

* * * * *